United States Patent [19]

Yamato et al.

[11] Patent Number: 5,068,897

[45] Date of Patent: Nov. 26, 1991

[54] MOBILE ACOUSTIC REPRODUCING APPARATUS

[75] Inventors: Toshitaka Yamato; Tatsuo Ito; Atsuyuki Takashima, all of Kobe; Akira Motojima, Akashi, all of Japan

[73] Assignee: Fujitsu Ten Limited, Hyogo, Japan

[21] Appl. No.: 514,833

[22] Filed: Apr. 26, 1990

[30] Foreign Application Priority Data

Apr. 26, 1989 [JP] Japan ..... 1-108211

[51] Int. Cl.[5] ..... H04R 5/02

[52] U.S. Cl. ..... 381/24; 381/86

[58] Field of Search ..... 381/86, 24, 97

[56] References Cited

U.S. PATENT DOCUMENTS 4,866,776 9/1989 Kasai et al. ..... 381/86

4,953,219 8/1990 Kasai et al. ..... 381/86

*Primary Examiner*—Forester W. Isen

*Attorney, Agent, or Firm*—Wenderoth, Lind & Ponack

[57] ABSTRACT

A center loudspeaker is disposed near the middle between the left channel loudspeaker arranged at the front left side of the compartment and the right channel loudspeaker at the front right side, and this center loudspeaker transforms into a sound by the level-controlled signal of the sum of the acoustic signals of the right and left channels, and phase- and level-controlled signals of the acoustic signals of the right and left channels. As a result, the sound field is localized in the front of the listener, and right and left symmetrical wide-spread sound fields may be composed. Additionally, tweeters are disposed outside the right and left channel loudspeakers, and the mounting angles of the tweeters are adjusted so that the sounds released from the tweeters may be at an equal sound pressure level between the listener at the driver's seat and the listener at the front side seat. As a result, the drift of the sound field in the medium and high sound ranges may be eliminated in a simple structure, and right and left symmetrical wide-spread sound field are composed. Furthermore, corresponding to the opening or closing state of the window glass or seated position, by controlling the phase and level of the sounds released from the loudspeakers and the tweeters, sound fields always symmetrical to the listening position and spread widely may be composed.

4 Claims, 7 Drawing Sheets

Fig. 1 (1)
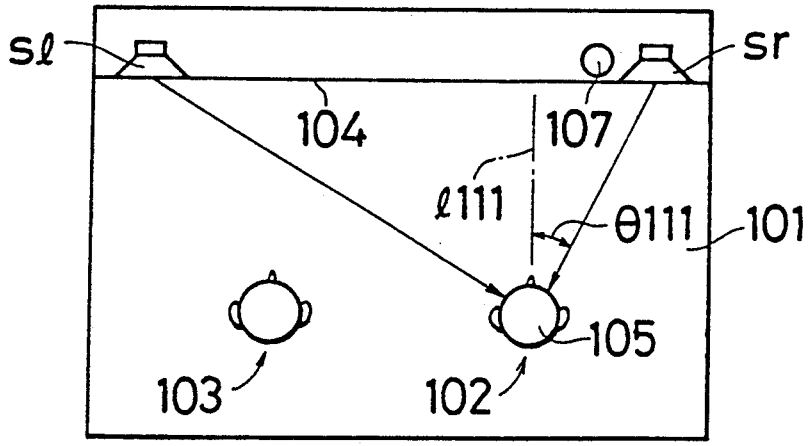
Fig. 1 (2)
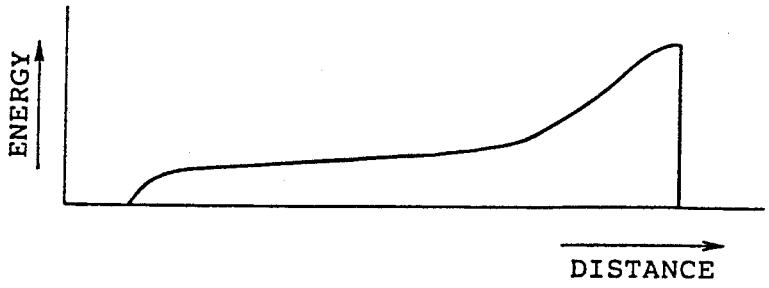

Fig. 3
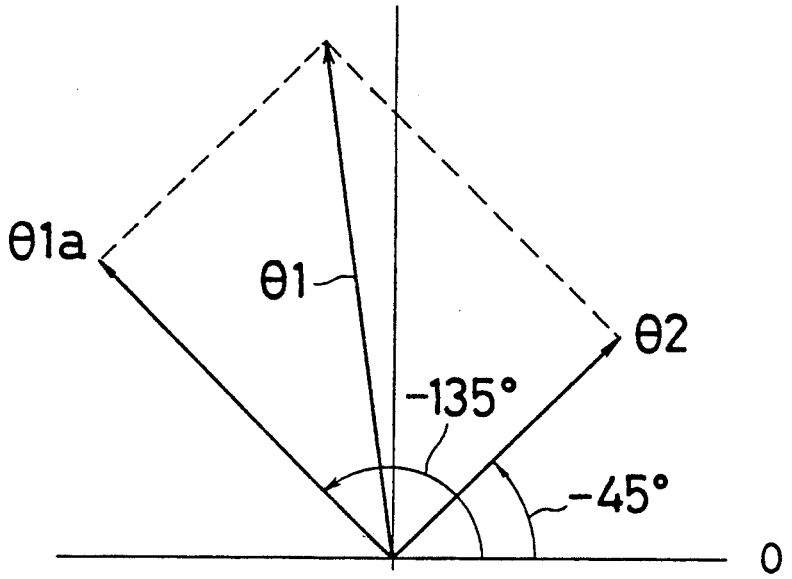
Fig. 5 (1)
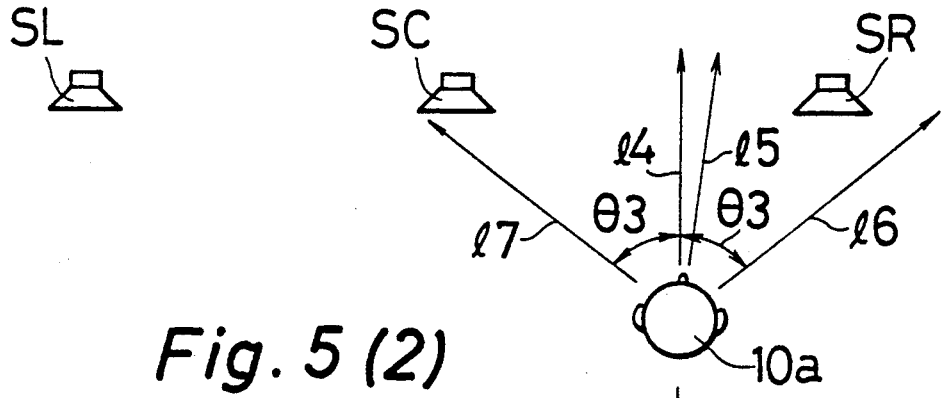
Fig. 5 (2)
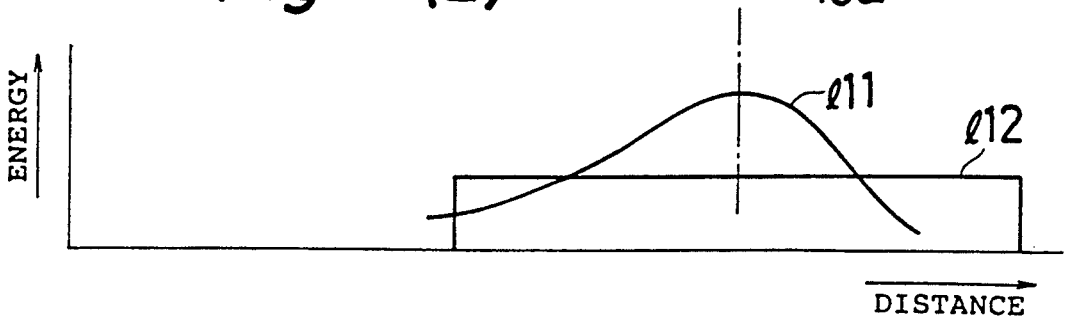

Fig. 4 (1)
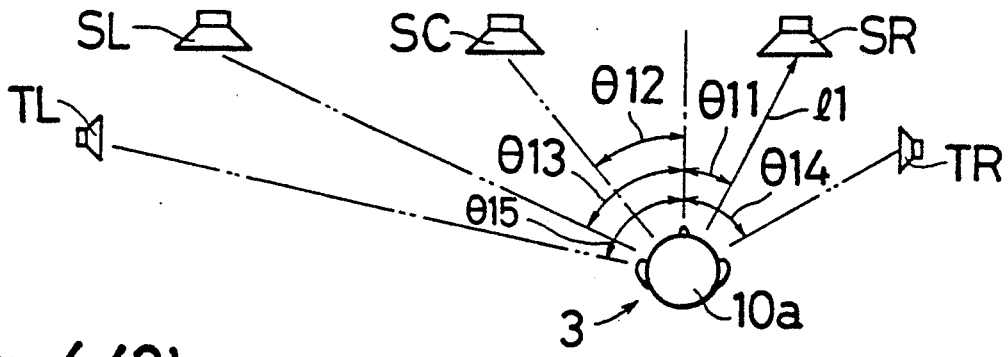
Fig. 4 (2)
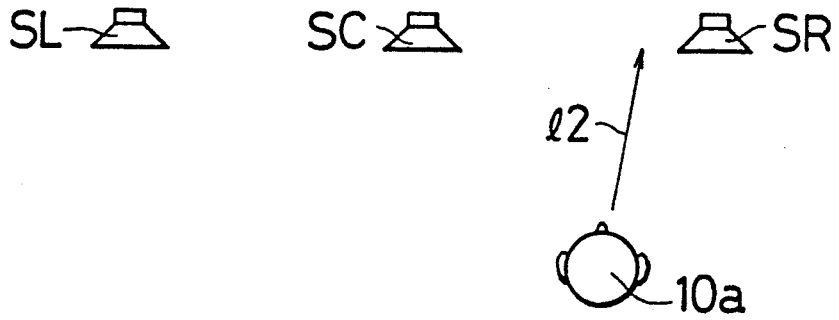
Fig. 4 (3)
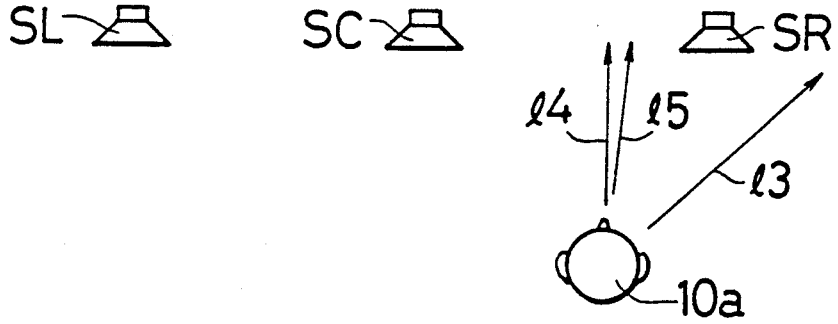
Fig. 4 (4)
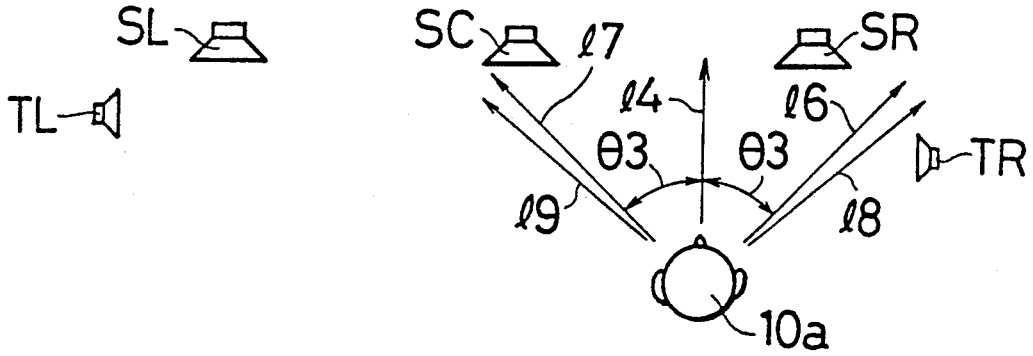

MOBILE ACOUSTIC REPRODUCING APPARATUS

BACKGROUND OF THE INVENTION

1. Field of the Invention

The present invention relates to a mobile acoustic reproducing apparatus designed to form optimum sound fields at both the driver's seat and the front side passenger's seat by installing loudspeakers at the forward right and left positions and near the middle position of the car compartment.

2. Description of the Prior Art

FIG. 1 is a plan view for explaining a prior art arrangement. In a conventional mobile acoustic reproducing apparatus, as shown in FIG. 1 (1), in a compartment 101, a right-channel loudspeaker sr is disposed at the front right position of a driver's seat 102, while a left-channel loudspeaker sl is disposed at the front left position of a side seat 103. These loudspeakers sl, sr are built in, for example, an instrument panel 104.

Therefore, referring to a driver 105, when sounds of equal energy level are released from the loudspeakers sl, sr, as shown in FIG. 1 (2), the acoustic energy distribution on the hearing sense of the driver 105 is not uniform between the left and right loudspeakers sl, sr, and it is deviated to the loudspeaker sr which is closer to the driver 105.

Accordingly, the localization position of a virtual sound source to be localized in the front direction of the driver 105 indicated by reference code l111 is deviated to the loudspeaker sr side as indicated by reference code 107. A similar problem occurs on the side seat 103.

In the limited space of the compartment 101, owing to the restrictions of the mounting positions of the loudspeaker sl, sr, the expansion angle indicated by reference code $\theta$111 is smaller than 30 degrees capable of forming an ideal sound field.

In the mobile acoustic reproducing apparatus of the prior art, hence, the localization direction of the sound field is deviated to form an asymmetrical sound field, and an acoustic reproduction full of presence cannot be realized.

SUMMARY OF THE INVENTION

It is hence a primary object of the invention to present a novel and improved mobile acoustic reproducing apparatus to solve the above-discussed problems.

It is other object of the invention to present a mobile acoustic reproducing apparatus capable of forming a wide-spread, symmetrical sound field, and reproducing the sound with full of presence.

To achieve the above objects, the invention presents a mobile acoustic reproducing apparatus which comprises:

right and left loudspeakers disposed at positions at mutually different directional angles at the front right and front left positions of the listener, a center loudspeaker positioned near the middle between the right and left loudspeakers, and disposed at a position of a directional angle larger than the one of the right and left loudspeakers and smaller than the other one, an acoustic signal source for delivering an acoustic signal of a left channel to the left loudspeaker and an acoustic signal of a right channel to the right loudspeaker, means for correcting the right channel and left channel acoustic signals by phase and level, and delivering as right and left correction signals, means for correcting the addition level by adding the acoustic signals of the right and left channels, correcting the level, and delivering as center correction signals, and means for adding the right and left correction signals and the center correction signal, and correcting the phase to feed to the center loudspeaker, which further comprises:

right and left tweeters disposed at the front right and front left sides of the listener and at a position of a larger directional angle than the directional angles of the right and left loudspeakers, right and left high pass filters for filtering signals over a predetermined frequency of the acoustic signals of the right and left channels, and feeding to the right and left tweeters, and right and left level adjusting means for adjusting the level ratio of acoustic signal levels supplied to the right and left tweeters and acoustic signal levels supplied to the right, left and center loudspeakers.

According to the invention, right and left loudspeakers are disposed at positions forming mutually different directional angles at the front right and front left sides of the listener, and a center loudspeaker is disposed at a position near the middle of these two loudspeakers and at a directional angle larger than one of the right and left loudspeakers and smaller than the other one.

Additionally, the tweeters which are smaller than the loudspeakers and which have fewer restrictions as to mounting positions are disposed at positions of larger directional angle than the directional angle of the right and left loudspeakers. That is, for example, as seen from the listener, when the directional angle of the right loudspeaker is smaller than the directional angle of the center loudspeaker, the right tweeter is disposed at the right side of the right loudspeaker, preferably, at a position nearly symmetrical to the center loudspeaker.

In the right and left tweeters, acoustic signals of the right and left channels are fed from the acoustic signal source through the right and left high pass filters. The high pass filters are to filter the signal components of the lower limit of the signal, for example, 1.6 kHz or higher frequency, incapable of localizing the sound image outside the right and left loudspeakers by the phase adjustment, and feed to the tweeters.

On the other hand, to the right and left loudspeakers, the acoustic signals of right and left channels are fed from the acoustic signal source after the level ratio is mutually adjusted with the tweeters, about the signal components above the specific frequency, at the right and left level adjusting means.

The left channel acoustic signal below the specified frequency is adjusted in phase and level by the left phase level correcting means, and thus prepared left correction signal, and the right correction signal similarly prepared by the right phase level correction means are added to the addition phase correction means. In this addition phase correction means, the sum acoustic signal of the right and left channels corrected in level by the addition level correction means is applied.

Therefore, by reproducing the acoustic signal from the addition phase correction means by the center loudspeaker, a symmetrical sound field at both sides of the listener can be formed. Additionally, by the sounds from the tweeters, a wide-spread presence may be formed.

Thus, according to the invention, the sound field may be localized in front of the listener, and a symmetrical and wide-spread sound field may be formed.

Furthermore, the invention presents a mobile acoustic reproducing apparatus which comprises first loudspeakers disposed at the front right, left and near middle positions of the compartment so as to compose a sound field at the left seat by the left first loudspeaker and the middle first loudspeaker and a sound field at the right seat by the right first loudspeaker and the middle first loudspeaker, by processing the phase of the left channel acoustic signal and feeding to the left side first loudspeaker, processing the phase of the right channel acoustic signal and feeding to the right side first loudspeaker, and processing the level and phase of the right and left channel acoustic signals and feeding to the first loudspeaker near the middle position, wherein second loudspeakers for reproducing the medium and high sound ranges are disposed at the right and left sides of the compartment, thereby processing the phase of the left channel acoustic signal and feeding to the left side second loudspeaker, and processing the phase of the right channel acoustic signal and feeding to the right side second loudspeaker, and the directivity of the left side second loudspeaker is adjusting by mounting so that the acoustic level from the second loudspeaker may be nearly equal at the left side seat and right side seat, and the directivity of the right side second loudspeaker is adjusted by mounting so that the acoustic level from the second loudspeaker may be nearly equal at the right side seat and left side seat.

Conforming to the invention, the first loudspeakers are disposed at the front right and left position and near the middle position of the compartment, and second loudspeakers for reproducing the medium and high sound ranges are located at the right and left sides of the compartment. The left channel acoustic signal is fed to the first and second loudspeakers at the left side of the compartment after the phase is processed. Similarly, the right channel acoustic signal is fed to the first and second loudspeakers at the right side of the compartment after the phase is processed. Furthermore, the right and left channel acoustic signals are fed to the first loudspeaker disposed near the middle after the level and phase are processed.

On the other hand, the left side second loudspeaker is installed so that the acoustic level from the second loudspeaker may be nearly equal at the left side seat and right side seat in directivity. The right side second loudspeaker is installed so that the acoustic level from the second loudspeaker may be nearly equal at the right side seat and left side seat in directivity.

Therefore, at the left side seat and right side seat, the sound field is composed of the first loudspeaker near the middle position and the left and right side first loudspeaker, and the medium and high sound ranges of this sound field are corrected by the right and left second loudspeakers.

According to the invention, correcting the medium and high ranges of the sound fields formed by the first loudspeakers by the second loudspeakers, the localization direction of the sound images may be stabilized in a specific direction without drift over the full frequency band of the reproduced sound, and the right and left sound fields may be composed symmetrically.

Still more, the invention presents a mobile acoustic reproducing apparatus which comprises:

right and left loudspeakers disposed at the front right and left positions of a listener, a center loudspeaker disposed near the middle of the right and left loudspeakers, an acoustic signal source for delivering the acoustic signal of the left channel to the left loudspeaker and the acoustic signal of the right channel to the right loudspeaker, and first addition means for adding up the acoustic signals of the right and left channels and delivering to the center loudspeaker, wherein part of the sound released from the right loudspeaker is reflected by the right wall to reach the listener at the right seat, while part of the sound released from the left loudspeaker is reflected by the left wall to reach the listener at the left seat, which further comprises:

reflected wave correction means composed of:

equalizer means having frequency characteristics of reflected waves by the right and left walls, delay means for compensating the propagation route difference of the direct sound from the center loudspeaker and the reflected waves, means for inverting the signal polarity, and means for adjusting the level of the attenuation corresponding to the reflectivity of the wall, thereby receiving the output from the first addition means, and second addition means for adding the output from the reflected wave correction means to the output from the first addition means, correcting the reflected wave, and delivering to the center loudspeaker.

In this constitution of the invention, the acoustic signal of the left channel from the acoustic signal source is transformed into a sound by the left loudspeaker disposed at the front left side of the listener, and the acoustic signal of the right channel is realized by the right loudspeaker disposed at the front right side of the listener. The acoustic signals of the right and left channels are added up by the first addition means, and delivered as a sound by the center loudspeaker disposed near the middle of the right and left loudspeakers. Therefore, at the left seat, a sound field is composed of the left loudspeaker and the center loudspeaker, while at the right seat a sound field is composed of the right loudspeaker and the center loudspeaker.

On the other hand, the output from the first addition means is applied to the reflected wave correction means, of which output is combined with the output from the first addition means in the second addition means, and the sum is delivered to the center loudspeaker. The reflected wave correction means comprises the equalizer means possessing the frequency characteristics of reflected waves by right and left walls forming the compartment, the delay means for compensating the propagation route difference between the direct sound released from the center loudspeaker and the reflected sound, the inverting means for inverting the signal polarity, and the level adjusting means for adjusting the signal level in response to the reflectivity of the walls.

Therefore, the reflected wave by the right wall released from the right loudspeaker and reaching the listener at the right seat is canceled by the direct sound from the center loudspeaker. Similarly, the reflected wave released from the left loudspeaker and reflected by the left wall and reaching the listener at the left seat is canceled by the direct sound released from the center loudspeaker.

Thus, the unnecessary spread of the sound field due to reflected waves is suppressed, so that symmetrical sound fields may be composed.

In this way, according to the invention, since the sound for canceling the reflected waves from the walls is released from the center loudspeaker disposed near the middle of the right and left loudspeakers, if there is any sound reflecting wall near the listener or the right and left loudspeakers, such effects may be substantially eliminated, so that symmetrical sound fields may be formed on right and left sides.

In addition, the invention presents a mobile acoustic reproducing apparatus comprising signal processing means for arithmetically processing stereo acoustic signals of right and left channels from acoustic signal sources by predetermined operational constants, composing plural acoustic signals, and delivering to corresponding plural loudspeakers, which also comprises seat position detecting means for detecting the position of the seat on which the listener sits, and constant setting means for setting the operational constants capable of obtaining right and left symmetrical sound fields, on the basis of the result of detection by the seat position detecting means, to the signal processing means.

In this invention, the signal processing means realized by digital signal processor and the like composes plural acoustic signals by arithmetically processing stereo acoustic signals of right and left channels from acoustic signal sources, by predetermined operational constants. The acoustic signals are transformed into sounds from the loudspeakers disposed at the front right and left side of the compartment.

On the other hand, relating to the seat on which the listener sits, there is a seat position detecting means, which detects the longitudinal position, height and inclination of the seat. The result of detection of the seat position detecting means is given to the constant setting means, which sets the operational constants capable of forming right and left symmetric sound fields at the seated position, corresponding to the detected seat position, in the signal processing means.

Therefore, in case of the physique of the listener changes and the seated position varies, the symmetrical sound fields may be automatically formed at the listening position of the listener.

Thus, according to the invention, by detecting the position of the seat on which the listener sits and setting the operational constants of the signal processing means depending on the detected result, even if the physique of the listener changes and the seated position varies, the symmetrical sound fields may be automatically formed at the listening point of the listener.

BRIEF DESCRIPTION OF THE DRAWINGS

Other and further objects, features, and advantages of the invention will be more explicit from the following detailed description taken with reference to the drawings wherein:

FIGS. 1(1) and 1(2) are plan views for explaining the prior art,

FIG. 3 is a graph for explaining the function of a crosstalk generation circuit 31*a*, FIGS. 4(1)–4(4) are plan views for explaining the function of sound field correction circuits 14 to 16, FIGS. 5(1) and 5(2) are acoustic energy distribution diagrams for explaining nonsymmetrical sound fields.

DETAILED DESCRIPTION OF THE PREFERRED EMBODIMENTS

Figure 2:
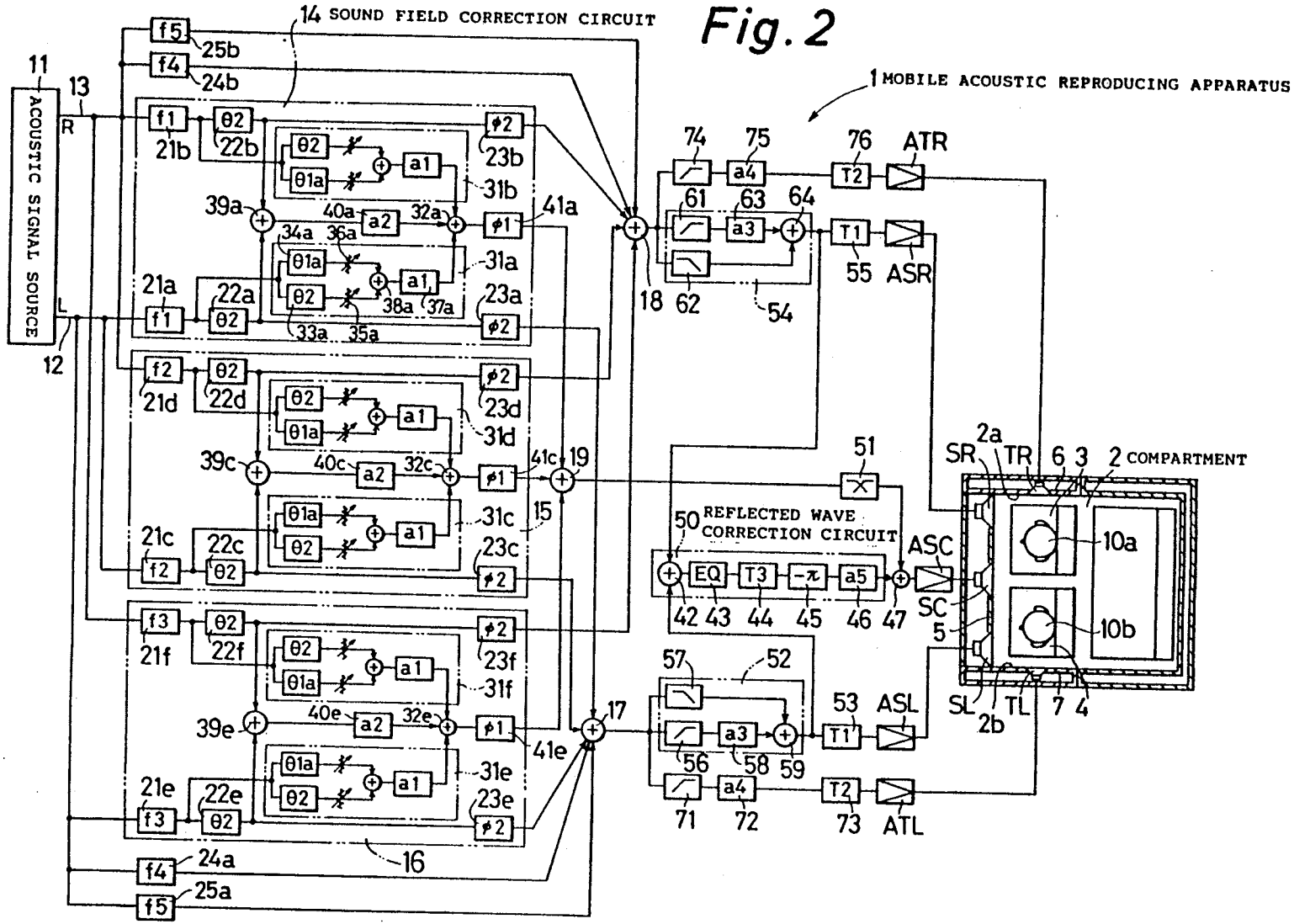
FIG. 2 is a block diagram showing an electronic composition of a mobile acoustic reproducing apparatus 1 in an embodiment of the present invention.

Now referring to the drawing, preferred embodiments of the invention are described below.

FIG. 2 is a block diagram showing an electronic composition of a mobile acoustic reproducing apparatus 1 in one of the embodiments of the invention. In an automobile compartment 2, loudspeakers SL, SC, SR are built in an instrument panel 5 disposed ahead of a driver's seat 3 and a side seat 4. That is, as seen from the driver's seat 3 and side seat 4, the loudspeaker SL is disposed at the left side, the loudspeaker SR at the right side, and the loudspeaker SC near the middle. Additionally, tweeters TR, TL are embedded respectively in a door 6 at the driver's seat 3 side and in a door 7 at the side seat 4 side.

From an acoustic signal source 11, such as a magnetic tape reproducing device and radio receiver set, an acoustic signal of a left channel is fed out into a line 12, and an acoustic signal of a right channel is fed out into a line 13. The acoustic signals of the two channels are fed to plural (three, in this embodiment) sound field correction circuits 14 to 16.

Generally, the acoustic propagation characteristic varies with the frequency, and therefore, near the entrance of the auditory canal of the listeners 10*a*, 10*b*, in order to unify the phase of all frequencies of the incoming sounds, the acoustic signals are preliminarily corrected in every specified frequency band in the sound field correction circuits 14 to 16. Therefore, the acoustic signal of the left channel fed into the sound field correction circuit 14 through the line 12 is delivered to a band pass filter (BPF) 21*a*, and the signal component of the frequency band fl (for example, 200 to 400 Hz) to be sound field corrected by the sound field correction circuit 14 is filtered. The output of the BPF 21*a* is delivered to an adder 17 after the phase is corrected by $\theta 2$, $\phi 2$, respectively, by phase correction circuits 22*a*, 23*a*.

Similarly, the acoustic signal of the right channel being fed out into the line 13 is filtered of the signal component in the frequency band fl by the BPF 21*b*, and is delivered to an adder 18 after the phase is corrected by $\theta 2$, $\phi 2$, respectively, by phase correction circuits 22*b*, 23*b*. In the sound correction circuit 15, likewise, the acoustic signal of the left channel is filtered of the signal component in frequency band f2 (for example, 400 to 800 Hz) by BPF 21*c*, and is delivered to the adder 17 after the phase is corrected by $\theta 2$, $\phi 2$, respectively, by phase correction circuits 22*c*, 23*c*, while the acoustic signal of the right channel is delivered from BPF 21*d* to the adder 18 by way of phase correction circuits 22*d*, 23*d*, in the same manner.

In the sound field correction circuit 16, the acoustic signal of the left channel is filtered of the signal component in frequency band f3 (for example, 800 to 1600 Hz) by BPF 21*e*, and is delivered to the adder 17 after the phase is corrected by $\theta 2$, $\phi 2$, respectively, by phase correction circuits 22*e*, 23*e*, while the acoustic signal of the right channel is delivered from BPF 21*f* to the adder 18 by way of phase correction circuits 22*f*, 23*f*.

A part of the acoustic signal of the left channel fed into the line 12 is delivered to the adder 17 through a high pass filter (HPF) 24*a* or a low pass filter (LPF) 25*a*. Similarly, a part of the acoustic signal of the right channel fed into the line 13 is delivered to the adder 18 through the HPF 24*b* or the LPF 25*b*. A cut-off frequency f4 of the HPF 24*a*, 24*b* is selected, for example, at 1600 Hz, while the cut-off frequency f5 of the LPF 25*a*, 25*b* is selected, for example, at 200 Hz.

In the sound field correction circuit 14, meanwhile, the outputs of the BPF 21*a*, 21*b* are fed to an adder 32*a* by way of crosstalk generation circuits 31*a*, 31*b*, respectively. The crosstalk generation circuit 31*a* comprises phase shifters 33*a*, 34*a*, attenuators 35*a*, 36*a*, 37*a*, and an adder 38*a*.

The output of the BPF 21*a* is corrected in phase by the phase shifter 33*a* by $\theta 2$ which is the reference phase, adjusted in level by the attenuator 35*a*, and is fed to the adder 38*a*, and is further changed by another reference phase $\theta 1a$ in the phase shifter 34*a*, and is fed to the adder 38*a* through the attenuator 36*a*. The phase $\theta 2$ is, for example, $-45$ degrees and the phase $\theta 1a$ is $-135$ degrees, and therefore as shown in FIG. 3, the output corrected by the phase $\theta 1$ is led out from the adder 38*a*, and the signal level is attenuated by the attenuation amount al in the attenuator 37*a*, and this signal is delivered to the adder 32*a*. Therefore, the signal delivered from the crosstalk generation circuit 31*a* can be changed in phase in a range of 0 to 90 degrees with respect to the signal of the phase $\theta 2$ delivered from the phase shifter 22*a*.

The acoustic signal of the right channel through the BPF 21*b* is similarly changed in phase by the crosstalk generation circuit 31*b*, and is fed to the adder 32*a*. In this adder 32*a*, moreover, the output corrected by the reference phase $\theta 2$ in the phase shifters 22*a*, 22*b*, combined in the adder 39*a* and attenuated by the attenuation amount a2 in the attenuator 40*a* is fed. The output from the adder 32*a* is corrected in phase by $\phi 1$ in the phase shifter 41*a* and is delivered to the adder 19.

Similarly, in the sound field correction circuit 15, there are crosstalk generation circuits 31*c*, 31*d*, adders 32*c*, 39*c*, attenuator 40*c* and phase shifter 41*c*, and the output from the phase shifter 41*c* is fed to the adder 19. The sound field correction circuit 16 comprises crosstalk generation circuits 31*e*, 31*f*, adders 32*e*, 39*e*, attenuator 40*e* and phase shifter 41*e*, and the output from the phase shifter 41*e* is fed to the adder 19.

The sum acoustic signal of the right and left channels from the adder 19 is applied to the loudspeaker SC through the power amplifier ASC from a frequency division filter 51. The left channel acoustic signal from the adder 17 is applied to the loudspeaker SL through the delay circuit 53 and power amplifier ASL from a frequency division filter 52. Likewise, the right channel acoustic signal from the adder 18 is applied to the loudspeaker SR through the delay circuit 55 and power amplifier ASR from a frequency division filter 54.

The frequency division filter 52 has its crosstalk frequency selected, for example, at 1600 Hz, and the level change rate is selected at 12 dB/oct. This frequency division filter 52 is composed of HPF 56, LPF 57, attenuator 58, and adder 59. The left channel acoustic signal from the adder 17 is filtered of the low frequency component by the LPF 57, and the higher frequency component through the HPF 57 is attenuated by the attenuation amount a3 in the attenuator 58 and is added to this low frequency component, and the sum is delivered. The cut-off frequency of the HPF 56 and LPF 57 is selected, for example, at 1600 Hz.

The frequency division filter 54 is similarly comprised of HPF 61, LPF 62, attenuator 63, and adder 64.

FIG. 4 is a plan view showing the function of the sound field correction circuits 14 to 16. For the listener 10*a* at the driver's seat 3*a*, the loudspeaker SR is disposed at a position with a directional angle of $\theta 11$, the loudspeaker SC at a position with a directional angle $\theta 12$ larger than $\theta 11$, and the loudspeaker SL at a position with a directional angle $\theta 13$ larger than $\theta 12$. Suppose the sound is emitted only from the loudspeaker SR as shown in FIG. 4 (1), then the listener 10*a* senses the sound source in the direction of reference code l1.

By contrast, as shown in FIG. 4(2), when the same sound is released from the loudspeaker SC together with the right channel sound from the loudspeaker SR, the listener 10*a* senses the sound source as being nearly in the front as indicated by the direction of reference code (2.

Accordingly, by converting the phase of the acoustic signal by $\theta 1$ by means of the crosstalk generation circuits 31*b*, 31*d*, 31*f* and changing the level by al, as shown in FIG. 4(3), the listener 10*a* senses the right channel sound source direction previously sensed at the loudspeaker SR side indicated by the reference code l2, outside of the loudspeaker SR as indicated by reference code l3.

In this state, however, when the left channel sound is released from the loudspeaker SC through the crosstalk generation circuits 31*a*, 31*c*, 31*e*, and the left channel acoustic signal through the phase shifters 22*a*, 22*c*, 22*e*, and phase shifters 23*a*, 23*c*, 23*e* is released from the loudspeaker SL, the localization direction of the sound image to be localized in the front direction of the listener 10*a* indicated by reference code l4 in FIG. 4(3) and FIG. 5(1) is deviated to the loudspeaker SR side as indicated by reference code l5.

This is because the acoustic energy distribution to be heard at the listening position of the listener 10*a* becomes asymmetrical as indicated by reference code l11 in FIG. 5(2) although the peak distribution is set in the front of the listener 10*a* as indicated by the reference code l4.

Correcting by the phase $\phi 1$ using the phase shifters 41*a*, 41*c*, 41*e*, as indicated by reference code l12 in FIG. 5(2), the acoustic energy distribution is made symmetrical. Therefore, as shown in FIG. 4(4) and FIG. 5(1), the localization direction of sound image is set in the front direction of the listener 10*a* as indicated by reference code l4, and furthermore, as indicated by reference codes l6, l7, the right and left symmetrical sound fields with a spreading angle of $\theta 3$ from the front direction can be composed. So that this spreading angle $\theta 3$ may compose an ideal sound field, for example, to be about 30 degrees, the phases $\theta 1$, $\phi 1$ are adjusted.

On the other hand, the left channel acoustic signal from the adder 17 is applied to the left channel tweeter TL through the HPF 71, attenuator 72, delay circuit 73 and power amplifier ATL. The right channel acoustic signal from the adder 18 is applied to the right channel tweeter TR through the HPF 74, attenuator 75, delay circuit 76 and power amplifier ATR. As shown in FIG. 4(1), the tweeter TR is disposed at a position forming a larger directional angle θ14 than the directional angle θ11, while the tweeter TL is disposed at a position forming a larger directional angle θ15 than the directional angle θ13.

The cut-off frequency of the HPF 71, 74 is, for example, 1600 Hz, and in this embodiment the high range over this cut-off frequency intense in directivity is adjusted by the mounting angle of the tweeters TL, TR as follows, while the spreading angle is expanded more than θ3, thereby suppressing the drift of the sound field in the high sound range.

Figure 6:
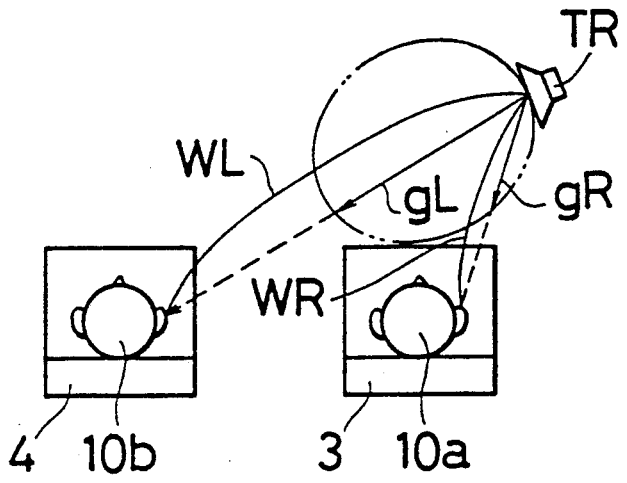
FIG. 6 is a plan view for explaining the method of determining the mounting angle of tweeter TR.

That is, concerning the tweeter TR, as shown in FIG. 6, supposing the output sound pressure level in the direction from tweeter TR to side seat 4 to be gL, the output sound pressure level in the driver's seat 3 direction to be gR, the distance from the tweeter TR to the side seat 4 to be WL, and the distance to the driver's seat 3 to be WR, it is mounted in the direction so as to satisfy the directivity characteristic shown in formula (1).

$$\frac{gL}{GR} \approx \frac{WL}{WR} \quad (1)$$

As a result, the driver's seat 3 and the side seat 4 may be set at an equal sound pressure level As for the left side tweeter TL, in the same manner as the tweeter TR, it is mounted in the direction so as to achieve the output sound pressure level corresponding to the distance to the driver's seat 3 and the distance to the side seat 4.

Hence, as indicated by reference codes l8, l9 in FIG. 4(4), symmetrical sounds fields having a wider spread than the spreading angle θ3 may be composed. At the same time, the drift of the sound image in the medium and high sound ranges is suppressed, and the sound image may be localized in the front direction of the listeners 10*a*, 10*b*. Meanwhile, the spreading angle θ3 may be changed over depending on the type of music or the like.

On the basis of the output from the frequency division filters 52, 54, the output for canceling the reflected waves by walls 2*a*, 2*b* of the compartment 2, such as window glass, is composed in a reflected wave correction circuit 50. The reflected wave correction circuit 50 comprises an adder 42 for adding the outputs from the frequency division filters 52, 54, an equalizer circuit 43 for extracting the frequency components of reflected waves from the walls 2*a*, 2*b* out of the output of the adder 42, a delay circuit 44 for compensating the time difference between the reflected wave and direct wave, a phase shifter 45 changing the phase of the output from the delay circuit 44 by $-\pi$, and attenuator 46. The output from the reflected wave correction circuit 50 is combined with the output from the frequency division filter 51 in the adder 47, and the sum output is delivered to the center loudspeaker SC.

Figure 7:
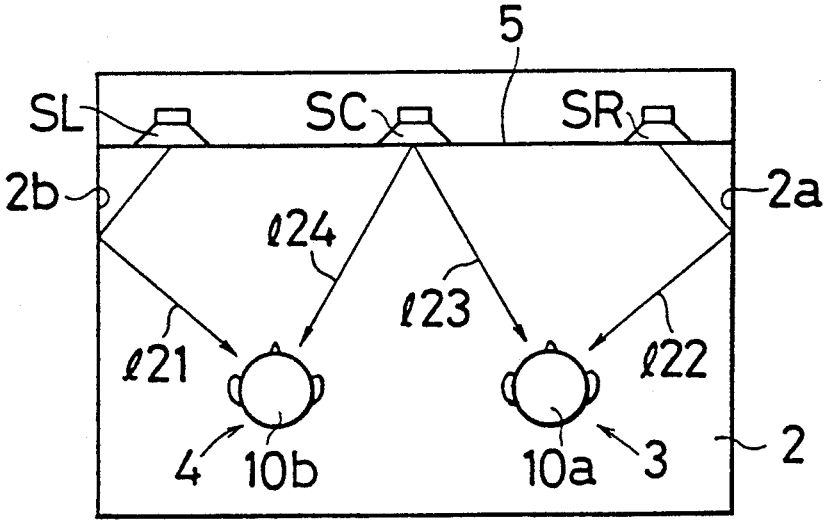
FIG. 7 is a plan view for explaining the principle of canceling reflected waves.

FIG. 7 is a plan view for explaining the principle of canceling the reflected waves. The sound released from the loudspeaker SL is mainly reflected by the wall 2*b* as indicated by reference code l21, and reaches the listener 10*b* at the side seat 4. The sound released from the loudspeaker SR is mainly reflected by the wall 2*a* as indicated by reference code l22, and reaches the listener 10*a* at the driver's seat 3.

Therefore, the loudspeaker SC releases the sound which has been delayed by the delay circuit 44 by the time difference T3 corresponding to the difference between the routes l23, l24 of the direct sound from the loudspeaker SC to the listeners 10*a*, 10*b* and the propagation route indicated by the reference codes l22, l21, further inverted in phase by $-\pi$ by the phase shifter 45, and then attenuated by the sound attenuation amount a5 corresponding to the absorption rate of the walls 2*a*, 2*b* by the attenuator 46. As a result, the reflected waves through the propagation routes indicated by the reference codes l21, l22 are canceled, so that asymmetrical spread of the sound field due to these reflected waves may be prevented.

Thus, in the acoustic reproducing apparatus 1 of this invention, in the front part of the compartment 2, the loudspeaker SC is disposed between the left channel loudspeaker SL and the right channel loudspeaker SR, and the acoustic signals of the left and right channels are fed to the loudspeakers SL, SR after changing by phase ϕ2, and the acoustic signals of the left and right channels are changed by phases θ1, ϕ1 and controlled in level by attenuation amount al to be applied to the center loudspeaker SC, so that the sound field may be localized in the front direction of the listeners 10*a*, 10*b*, thereby composing symmetrical and wide-spread sound fields.

Additionally, as seen from the listeners 10*a*, 10*b*, tweeters TL, TR are disposed outside of the loudspeakers SL, SR, and these tweeters TL, TR are mounted in a direction so that the sound pressure level may be equal at the driver's seat 3 and side seat 4, which also makes it possible to compose symmetrical wide-spread sound fields and to eliminate the drift of the sound field in the medium and high sound ranges.

Incidentally, only the small-sized tweeters TL, TR for reproducing the medium and high sound ranges are built in doors 6, 7, and therefore the mounting restrictions are few, so that they may be installed at positions for satisfying the above desired characteristics. Moreover, since the sound field correction is effected by adjusting the mounting angles of the tweeters TL, TR, it is possible to realize a simple structure without requiring any particular electric structure.

By the reflected wave correction circuit 50, the acoustic signal for cancel the reflected waves by the walls 2*a*, 2*b*, such as window glass, is created and delivered from the loudspeaker SC, and therefore if there are walls 2*a*, 2*b* to reflect the sound near the loudspeakers SL, SR or the listeners 10*a*, 10*b*, the undesired spread of the sound field due to reflected waves from the walls 2*a*, 2*b* is prevented, so that symmetrical sound fields may be formed at the driver's seat 3 and side seat 4.

Figure 8:
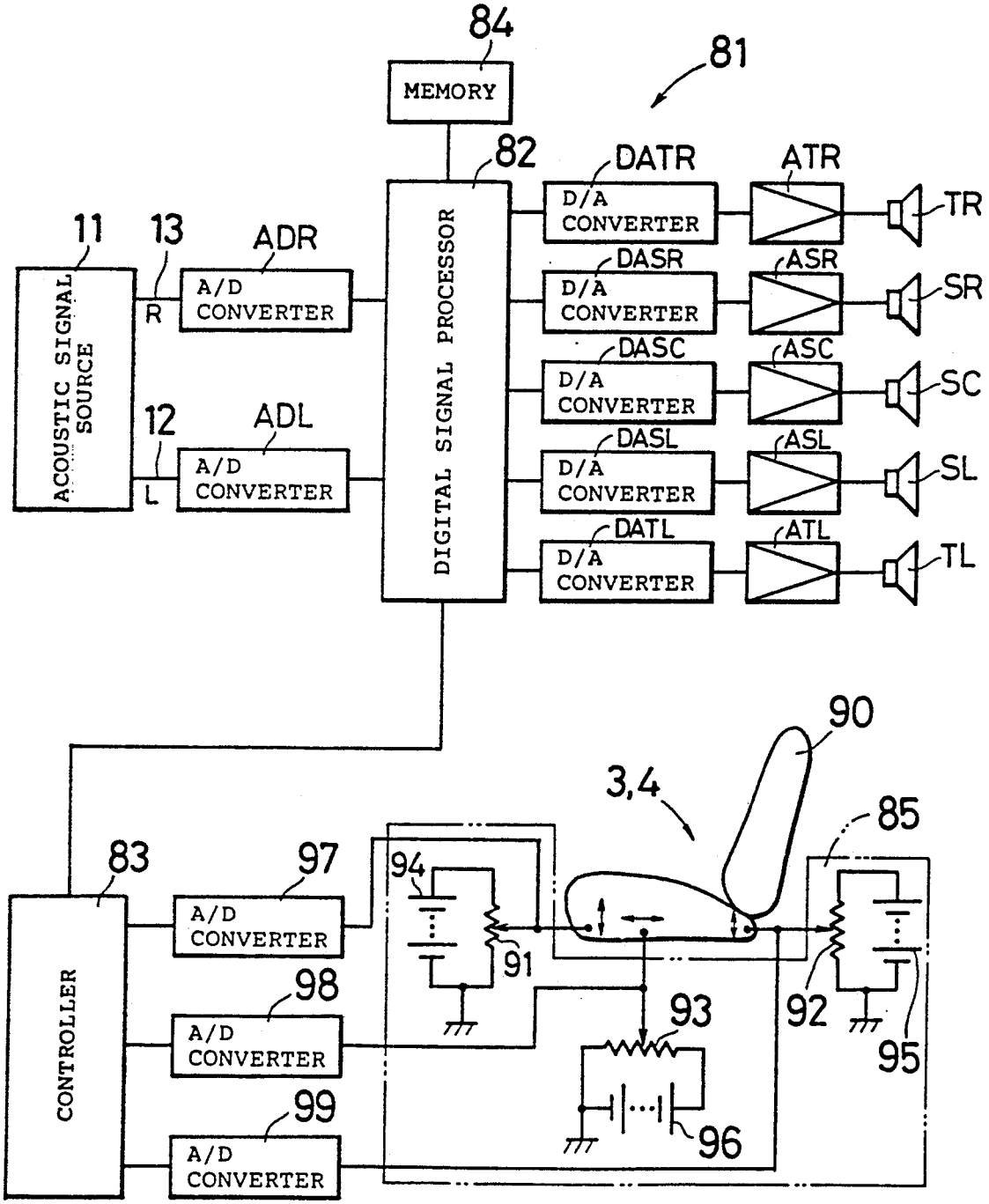
FIG. 8 is a block diagram showing an electronic composition of a mobile acoustic reproducing apparatus 81 in other embodiment of the present invention.

FIG. 8 is a block diagram for showing the electronic composition of an acoustic reproducing apparatus 81 in other embodiment of the invention, and this embodiment is similar to the foregoing embodiment, and the corresponding parts are identified with the same reference codes. In this embodiment, the arithmetic processing in the sound field correction circuits 14 to 16 and reflected wave correction circuit 50 is performed within a digital signal processor 82. Therefore, the acoustic signals of the right and left channels from the acoustic signal source 11 are once converted into digital signals by analog/digital converters ADR, ADL, respectively, and then fed into the digital signal processor 82.

Relating to this digital signal processor 82, there are a control part 83 for setting the operational constants in the digital signal processor 82, and a memory 84 used in calculation of reverberation sound or the like. The digital signal processor 82 is responsible for, aside from correction of the sound field and correction of reflected waves as mentioned above, arithmetically processing the acoustic signals so that the sound image may be localized at the position corresponding to the driver's seat 3 as described below, and delivering to digital-/analog converters DASL, DASR; DASC; DATAL, DATR.

On the other hand, relating to the driver's seat 3 and side seat 4, a seated position detecting means 85 is built in the seat 90. This seated position detecting means 85 comprises slide resistors 91 to 93 having either the movable side or the fixed side fixed to the seat 90 and the other side fixed to the car body, and power supplies 94 to 96 for applying a specific voltage thereto.

The front height of the seat 90 is detected by the slide resistor 91, and the rear height by the slide resistor 92, while the longitudinal position is detected by the slide resistor 93. The results of detection are converted into digital signals by the analog/digital converters 97 to 99, respectively, and are fed to the control part 83. The average of the front height and the rear height may be regarded as the sitting surface height of the seat 90, and the difference three between is regarded as the inclination of the seat surface.

The control part 83, on the basis of the position information of the seat 90 detected in this way, sets the operational constants corresponding to the phases $\theta 1$, $\phi 1$, and attenuation amounts a1, a2, a3 in FIG. 2 of the digital signal processor 82. The operational constants are preliminarily determined by experiment or the like corresponding to the position of the seat 90.

Figure 9:
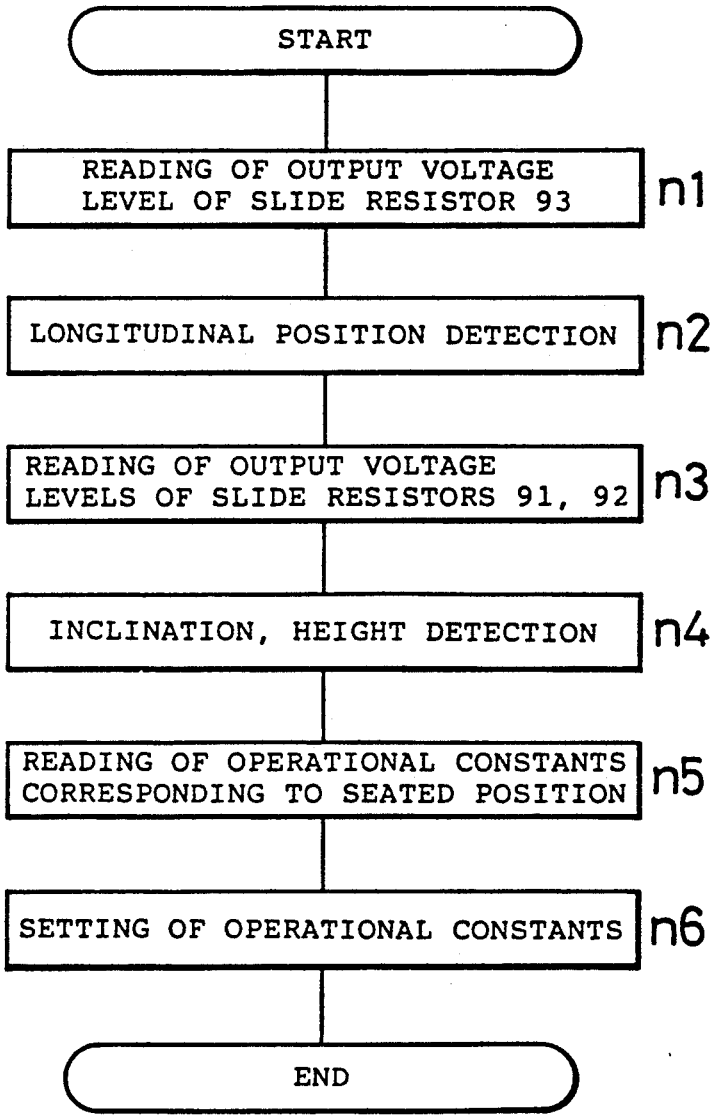
FIG. 9 is a flowchart for explaining the setting of operational constants corresponding to the seated position in a digital signal processor 82 used in the mobile acoustic reproducing apparatus 81.

FIG. 9 is a flowchart for explaining the operation of setting operational constants in the digital signal processor 82 corresponding to the seated position by the control part 83. At step n1, the output voltage level of the slide resistor 93 is read, and at step n2 the longitudinal position of the seat 90 is detected on the basis of that output voltage level. Similarly, at step n3, the output voltage levels of the slide resistors 91, 92 are read, and the seat inclination and height are calculated at step n4.

At step n5, the operational constants corresponding to the seated position information obtained at steps nl to n4 are read out, and these operational constants are set in the digital signal processor 82 at step n6.

In this way, the position of the seat 90 is detected by the seated position detecting means 85, and the operational constants in the digital signal processor 82 are changed depending on the results of detection, so that the sound field is automatically localized at the listening point for the listeners 10*a*, 10*b*. Therefore, without having to operate complicatedly for adjusting the localization position of the sound image by the listeners 10*a*, 10*b*, the controllability and functionality may be substantially enhanced.

Moreover, the operational constants may be set as follows. That is, the control part 83 reads the output voltage levels of the slide resistors 91 to 93 after analog/digital conversion, reads out the operational constants preliminarily stored in the memory region from the memory region of the address corresponding to the address data composed of the combination of the data of the results of conversion, and sets in the digital signal processor 82.

Alternately, opening detecting means for detecting the opening or closing state of the window glass may be disposed, and the operational constants in the digital signal processor 82 may be varied by the control part 83, in response to the output from this opening detecting means. In this case, by correcting the phases $\theta 1$, $\phi 1$ and the attenuation amounts al to a5 in FIG. 2, it is possible to release the sound at the output sound pressure level corresponding to the reflected sound level varying with the opening or closing state of the window glass.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A mobile acoustic reproducing apparatus comprising:

right and left loudspeakers disposed at positions at mutually different directional angles at the front right and front left positions of the listener, a center loudspeaker positioned near the middle between the right and left loudspeakers, and disposed at a position of a directional angle larger than one of the right and left loudspeakers and smaller than the other one of the right and left loudspeakers, an acoustic signal source for delivering an acoustic signal of a left channel to the left loudspeaker and an acoustic signal of a right channel to the right loudspeaker, means for correcting the right channel and left channel acoustic signals by phase and level, and providing corresponding right and left correction signals, means for adding the acoustic signals of the right and left channels, correcting the level thereof, and providing corresponding center correction signals, means for adding the right and left correction signals and the center correction signal, and correcting the phase to feed to the center loudspeaker, right and left tweeters disposed at the front right and front left sides of the listener and at a position of a larger directional angle than the directional angles of the right and left loudspeakers, right and left high pass filters for filtering signals over a predetermined frequency of the acoustic signals of the right and left channels, and feeding corresponding filtered signals to the right and left tweeters, and right and left level adjusting means for adjusting the level ratio of acoustic signal levels supplied to the right and left tweeters and acoustic signal levels supplied to the right, left and center loudspeakers.

2. A mobile acoustic reproducing apparatus comprising:

first loudspeakers disposed at the front right, left and near middle positions of a compartment so as to compose a sound field at a left seat by the left first loudspeaker and the middle first loudspeaker and a sound field at a right seat by the right first loudspeaker and the near middle first loudspeaker, by processing the phase of the left channel acoustic signal and feeding a corresponding signal to the left side first loudspeaker, processing the phase of the right channel acoustic signal and feeding a corresponding signal to the right side first loudspeaker, and processing the level and phase of the right and left channel acoustic signals and feeding a corresponding signal to the near middle first loudspeaker, and second loudspeakers for reproducing medium and high sound ranges, disposed at the right and left sides of the compartment, by processing the phase of the left channel acoustic signal and feeding a corresponding signal to the left side second loudspeaker, and processing the phase of the right channel acoustic signal and feeding a corresponding signal to the right side second loudspeaker, wherein the directivity of the left side second loudspeaker is mountably adjusted so that the acoustic level from the left side second loudspeaker is substantially equal at the left side seat and right side seat, and the directivity of the right side second loudspeaker is mountably adjusted so that the acoustic level from the right side second loudspeaker is substantially equal at the right side seat and left side seat.

3. A mobile acoustic reproducing apparatus comprising:

right and left loudspeakers disposed at the front right and left positions of a listener, a center loudspeaker disposed near the middle of the right and left loudspeakers, an acoustic signal source for delivering the acoustic signal of the left channel to the left loudspeaker and the acoustic signal of the right channel to the right loudspeaker, and first addition means for adding up the acoustic signals of the right and left channels and delivering to the center loudspeaker, wherein part of the sound released from the right loudspeaker is reflected by the right wall to reach the listener at the right seat, while part of the sound released from the left loudspeaker is reflected by the left wall to reach the listener at the left seat, which further comprises:

reflected wave correction means composed of:

equalizer means having frequency characteristics of reflected waves by the right and left walls, delay means for compensating the propagation route difference of the direct sound from the center loudspeaker and the reflected waves, means for inverting the signal polarity, and means for adjusting the level of the attenuation corresponding to the reflectivity of the wall, thereby receiving the output from the first addition means, and second addition means for adding the output from the reflected wave correction means to the output from the first addition means, correcting the reflected wave, and delivering to the center loudspeaker.

4. A mobile acoustic reproducing apparatus comprising:

signal processing means for arithmetically processing according to predetermined operation constants right and left channel stereo acoustic signals output from an acoustic signal source, and for composing and outputting corresponding plural acoustic signals to respective plural loudspeakers;

seat position detecting means associated with a seat upon which a listener sits, the seat being movable fore and back and having an adjustable reclining angle, said seat position detecting means for detecting a seat position and reclining angle of the seat; and, constant setting means for setting the operational constants to obtain a right and left symmetrical sound field about the head of the listener sitting on the seat based on the seat position and reclining angle detected by the seat position detecting means, and for providing the operational constants to the signal processing means.

* * * * *